US009924809B2

(12) United States Patent
Forrest et al.

(10) Patent No.: US 9,924,809 B2
(45) Date of Patent: Mar. 27, 2018

(54) RETAIL DISPLAY SYSTEM AND PLANAR DISPLAY ASSEMBLIES

(71) Applicant: LIBERTY HARDWARE MFG. CORP., Winston-Salem, NC (US)

(72) Inventors: Earl David Forrest, Asheboro, NC (US); Norman Dax Allen, Asheboro, NC (US); Lauren Brenzy, Winston-Salem, NC (US); Jeffrey John Mathison, Chicago, IL (US); Kurt Weaver, Winston-Salem, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 2 days.

(21) Appl. No.: 15/016,704

(22) Filed: Feb. 5, 2016

(65) Prior Publication Data

US 2017/0105549 A1 Apr. 20, 2017

Related U.S. Application Data

(63) Continuation-in-part of application No. 15/004,512, filed on Jan. 22, 2016.

(Continued)

(51) Int. Cl.

*A47F 7/00* (2006.01)
*A47G 1/16* (2006.01)

(Continued)

(52) U.S. Cl.

CPC ..... *A47F 7/0042* (2013.01); *A47F 5/0876* (2013.01); *A47G 1/0616* (2013.01); *A47G 1/16* (2013.01); *A47G 2001/0677* (2013.01)

(58) Field of Classification Search

CPC ..... A47F 7/0042; A47F 5/0876; A47F 10/02; A47G 1/16; A47G 1/0616; A47G 2001/0677; G09B 25/00; B65D 85/48

See application file for complete search history.

(56) References Cited

U.S. PATENT DOCUMENTS 908,608 A 1/1909 Pullen
1,354,270 A 9/1920 Wood (Continued)

FOREIGN PATENT DOCUMENTS

BR 102012014391 A2 6/2014
CN 201589049 U 9/2010

(Continued)

OTHER PUBLICATIONS

About Smart Mirror Glass, Two Way Mirrors Privacy & Security Products, Product Comparison, 3 pages, Dec. 22, 2015.

(Continued)

*Primary Examiner* — Mark J Beauchaine

(74) *Attorney, Agent, or Firm* — Brooks Kushman P.C.; Lora Graentzdoerffer

(57) ABSTRACT

A retail display system is provided with a point-of-sale display unit sized to be received in a retail store aisle. A plurality of planar display panes with varying sizes and varying styles are oriented within the display unit. Mounting hardware kits are common for the plurality of planar display panes, and are oriented within the display unit, to mount the plurality of planar display planes at varying distances from an upright support surface. A plurality of frames with varying sizes and varying styles, are sized to mount about one of the plurality of planar display panes, and are oriented within the display unit. Instructional indicia are provided on the display unit to inform a customer to select at least one planar display pane and at least one frame.

20 Claims, 7 Drawing Sheets

Related U.S. Application Data

(60) Provisional application No. 62/243,819, filed on Oct. 20, 2015.

(51) Int. Cl.
*A47F 5/08* (2006.01)
*A47G 1/06* (2006.01)

(56) References Cited

U.S. PATENT DOCUMENTS 2,181,874 A 12/1939 Cross
2,469,923 A 5/1949 Jones
2,696,962 A 12/1954 Goss
3,208,876 A 9/1965 Dodge
3,471,111 A 10/1969 MacDonald
3,471,112 A 10/1969 MacDonald et al.
3,501,124 A 3/1970 Goss
3,546,802 A 12/1970 Preston
3,685,186 A * 8/1972 Goodman ..... G09F 7/08 40/576
4,027,413 A 6/1977 Moede
4,037,813 A 7/1977 Loui et al.
4,053,132 A 10/1977 Del Pozzo
4,084,700 A * 4/1978 Dunchock ..... A47F 7/021 211/41.1
4,324,332 A * 4/1982 Willis ..... A47G 1/06 206/445
4,432,523 A 2/1984 Follows
4,557,457 A 12/1985 Cockfield et al.
4,666,117 A 5/1987 Taft
4,732,358 A 3/1988 Hughes et al.
4,819,901 A 4/1989 McDonald
D301,413 S 6/1989 Rosen
4,991,329 A 2/1991 Wilson
5,380,080 A 1/1995 Rubin et al.
D364,055 S 11/1995 Pakla
5,759,045 A * 6/1998 Gabig ..... G09F 1/00 434/367
5,761,839 A * 6/1998 Heikkila ..... G09F 15/0012 40/730
6,186,456 B1 2/2001 Marsh
6,286,802 B1 9/2001 Munson et al.
6,572,943 B2 6/2003 Shaffer
6,964,487 B2 11/2005 Olsen et al.
D536,659 S 2/2007 Panasewicz et al.
7,337,729 B2 3/2008 Briosi
7,967,400 B1 6/2011 Collum
8,468,767 B1 6/2013 McBride
8,495,830 B2 7/2013 Price
D706,064 S 6/2014 Ota et al.
9,027,766 B1 5/2015 Serotta et al.
D758,771 S 6/2016 Austin, III et al.
D763,023 S 8/2016 Austin, III et al.
D799,862 S 10/2017 Laumerich et al.
2002/0081409 A1 6/2002 Shaffer
2003/0038222 A1 2/2003 Holmes
2004/0074130 A1 4/2004 Chatterjea
2004/0221772 A1 11/2004 Narkis et al.
2005/0109910 A1 5/2005 Vander Berg et al.
2007/0069358 A1 3/2007 McAllister et al.
2007/0153375 A1 7/2007 Peterson et al.
2008/0023615 A1 1/2008 Scarcello
2008/0078916 A1 4/2008 Nevers et al.
2008/0148692 A1* 6/2008 Wisecarver ..... B65D 5/5021 53/462
2008/0216374 A1 9/2008 Ozmun
2008/0236053 A1 10/2008 Adams et al.
2008/0237434 A1 10/2008 Lin
2008/0251413 A1 10/2008 Blumenau-Bebry
2009/0294610 A1 12/2009 Paharik et al.
2010/0060807 A1 3/2010 Green et al.
2010/0140428 A1 6/2010 Vassallo
2010/0229442 A1 9/2010 Snow et al.
2010/0276562 A1 11/2010 Nguyen
2011/0266406 A1 11/2011 Westimayer et al.
2011/0271571 A1 11/2011 Lennard
2012/0030978 A1 2/2012 Miller
2012/0032062 A1 2/2012 Newville
2012/0103982 A1* 5/2012 McDonald ..... B65D 5/0254 220/62
2012/0144708 A1 6/2012 Schwartz
2012/0145847 A1 6/2012 Wang
2012/0222341 A1 9/2012 Tucker
2012/0260549 A1 10/2012 Andrulewich
2012/0306188 A1 12/2012 Chen
2013/0026319 A1 1/2013 Crescenzo
2013/0048812 A1 2/2013 Lozano
2013/0112637 A1 5/2013 Kuhn
2013/0180142 A1 7/2013 Kressin et al.
2013/0256476 A1 10/2013 Ripke
2013/0256487 A1 10/2013 Ko
2013/0269170 A1 10/2013 Goldberg
2013/0321715 A1 12/2013 Millson et al.
2013/0325670 A1* 12/2013 Austin, III ..... G06Q 30/06 705/27.1
2014/0030490 A1 1/2014 Crosby et al.
2014/0231611 A1 8/2014 Svihilik
2014/0263923 A1 9/2014 McKinney
2014/0291460 A1 10/2014 Warncke et al.
2015/0071475 A1 3/2015 Hose et al.
2015/0075046 A1 3/2015 Skinner
2015/0269875 A1 9/2015 Corcoran et al.
2015/0272352 A1 10/2015 Chowdhury et al.
2015/0335152 A1 11/2015 Buettner
2016/0007742 A1 1/2016 Yang

FOREIGN PATENT DOCUMENTS

CN 201764226 U 3/2011
CN 203857240 U 10/2014
CN 204114511 U 1/2015
CN 204141192 U 2/2015
DE 102012100562 A1 7/2013
GB 2508404 A 6/2014
KR 2020110007036 7/2011
KR 2020120006811 10/2012

OTHER PUBLICATIONS

The Source for Fine Art, "Glass vs. Acrylic: Demystifying Glazing", 4 pages, Jan. 10, 2015.

* cited by examiner

RETAIL DISPLAY SYSTEM AND PLANAR DISPLAY ASSEMBLIES

CROSS-REFERENCE TO RELATED APPLICATIONS

This application is a continuation-in-part of U.S. application Ser. No. 15/004,512 filed Jan. 22, 2016, which, in turn, claims the benefit of U.S. provisional application Ser. No. 62/243,819 filed Oct. 20, 2015, the disclosures of which are hereby incorporated in their entirety by reference herein.

TECHNICAL FIELD

Various embodiments relate to planar display assemblies and retail display systems for planar display assemblies, such as mirror assemblies.

BACKGROUND

Prior art planar display assemblies, such as mirror assemblies, offer preassembled mirror assemblies with or without a frame. Separate frames and mirror panes are also offered, which require a user to assemble the mirror to the frame, often utilizing various tools. Hardware is installed to mount the frame of a framed mirror assembly to an upright support surface. For unframed mirror assemblies, the hardware is installed to the mirror pane.

SUMMARY

According to at least one embodiment, a retail display system is provided with a point-of-sale display unit sized to be received in a retail store aisle. A first plurality of planar display panes with a first size and a first style are oriented within the display unit. A second plurality of planar display panes with a second size and second style are oriented within the display unit. At least one of the second size and the second style is different from the first size and the first style. Mounting hardware kits are common for both of the first plurality of planar display panes and the second plurality of planar display panes, are oriented within the display unit, to mount one of the first plurality of planar display planes and the second plurality of planar display panes at varying distances from an upright support surface.

According to at least another embodiment, a retail display system is provided with a point-of-sale display unit sized to be received in a retail store aisle. A first plurality of planar display panes is oriented with the display unit. At least one first frame with a first size and a first style, is sized to mount about one of the first plurality of planar display panes, and is oriented within the display unit. At least one second frame with a second size and a second style, is sized to mount about one of the first plurality of planar display panes, and is oriented within the display unit. At least one of the second size and the second style is different from the first size and the first style.

According to at least another embodiment, a retail display system is provided with a point-of-sale display unit sized to be received in a retail store aisle. A first plurality of planar display panes with a first size and a first style oriented within the display unit. A second plurality of planar display panes with a second size and second style is oriented within the display unit. At least one of the second size and the second style is different from the first size and the first style. A first plurality of frames with a first size and a first style, is sized to receive one of the first plurality of planar display panes, and is oriented within the display unit. A second plurality of frames with a second size and a second style, sized to receive one of the first plurality of planar display panes, and oriented within the display unit. At least one of the second size and the second style is different from the first size and the first style. Instructional indicia are provided on the display unit to inform a customer to select at least one planar display pane and at least one frame.

According to at least another embodiment, a retail display system is provided with a point-of-sale display unit sized to be received in a retail store aisle. A first plurality of packaged planar display panes is oriented with the display unit. At least one packaged first frame with a first size and a first style, is sized to mount about one of the first plurality of planar display panes, and is oriented within the display unit. A planar display assembly is oriented upon the point-of-sale display. The planar display assembly includes an unpackaged planar display pane that corresponds to the first plurality of packaged planar display panes, which is mounted to an upright support surface of the point-of-sale display unit. An unpackaged partial frame that corresponds to the at least one packaged first frame, is mounted to the unpackaged planar display pane to depict the planar display assembly at retail with and without a frame.

According to at least another embodiment, a method for retailing customizable planar display assemblies provides a plurality of planar display panes with varying sizes and varying styles oriented within a display unit. A plurality of frames with varying sizes and varying styles is provided in the display unit. The plurality of frames is each sized to receive one of the plurality of planar display panes. Mounting hardware kits that are common for the plurality of planar display panes are provided to mount the plurality of planar display panes to an upright support surface. Instructional indicia is provided to inform a customer to select at least one planar display pane, to determine if the display pane is to be framed and if so, to select at least one frame that is sized for the at least one planar display pane, and to select one of the mounting hardware kits.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Conventional planar display assemblies, such as mirror assemblies, offer preassembled mirror assemblies with or without a frame. Separate frames and mirror panes are also offered, which require a user to assemble the mirror to the frame, often utilizing various tools. Hardware is installed to mount the frame of a framed mirror assembly to an upright support surface. For unframed mirror assemblies, the hardware is installed to the mirror pane. Dedicated hardware and tools are required for assembling and installing each mirror assembly, which requires significant efforts, components and costs to make any changes. Likewise options for various combinations may be limited.

Figure 1:
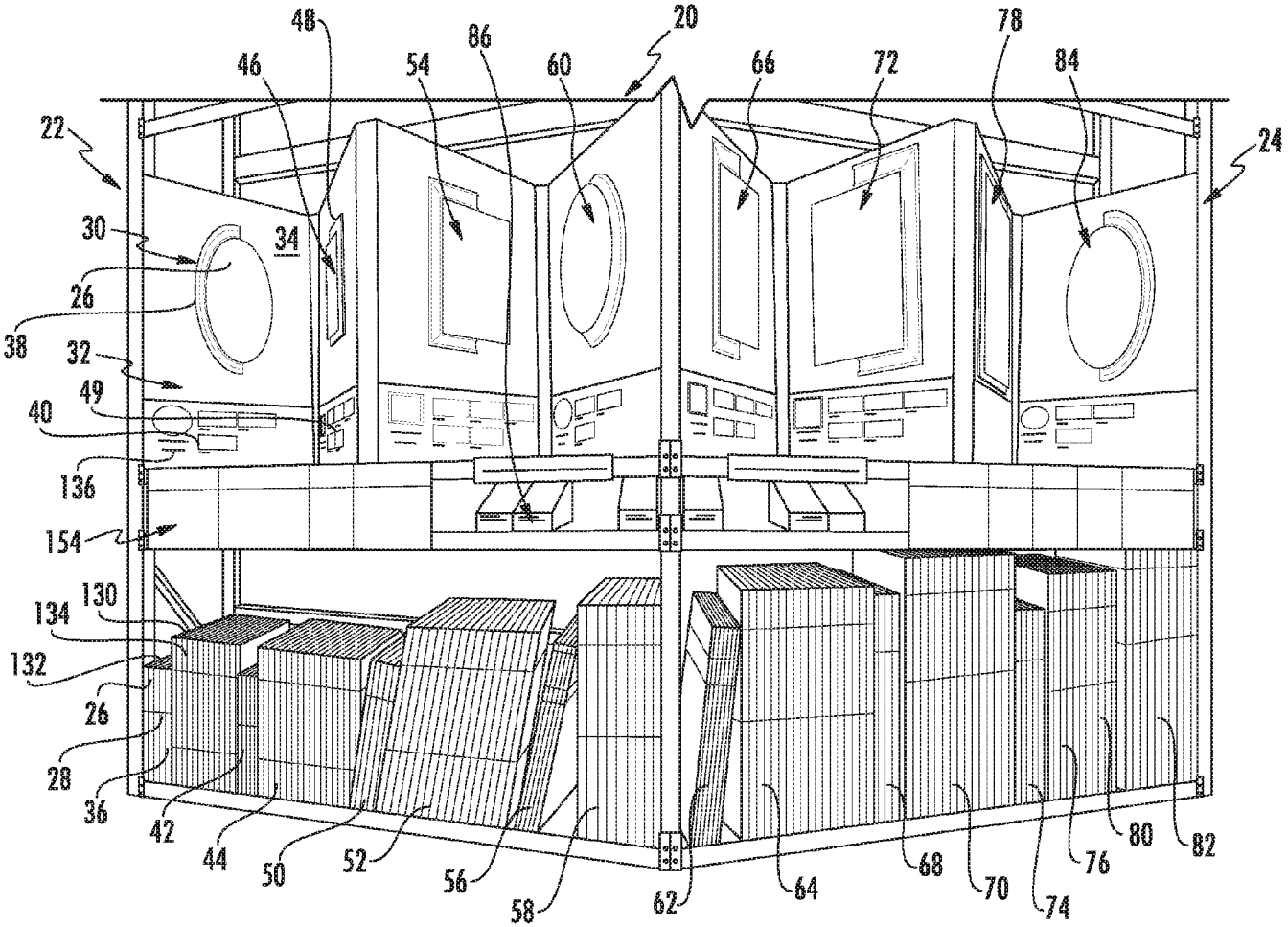
FIG. 1 is a panoramic perspective view of a retail display system for mirror assemblies according to an embodiment.

Referring now to FIG. 1, a retail display system for planar display assemblies, such as mirror assemblies, is illustrated according to an embodiment, and referenced generally by numeral 20. The display system 20 is sized to be displayed within a retail store aisle, such as a home improvement store. The display system 20 is utilized for both displaying and retailing mirror assembly components. Although mirror assembly components are illustrated and described, any planar display assembly components may be employed, such as components for framing pictures.

The retail display system 20 includes a pair of point-of-sale display units 22, 24. Of course, any number of point-of-sale display units 22, 24 is contemplated; and as will be explained, it is advantageous to provide the greatest variety of products per each point-of-sale display unit 22, 24. The point-of-display units 22, 24 are sized to be received within a retail store aisle; and may be sized the same as conventional shelving for prior art mirror assembly retail displays for easy replacement.

The retail system 20 provides standardized or common mounting and assembly hardware to offer ease in customer selection, customization, assembly, installations, modifications, replacements, and the like. The retail system 20 includes a plurality of packaged mirror panes 26 of a small oval size and a particular style, such as standard glass. Adjacent to the mirror panes 26, are another plurality of packaged mirror panes 28 having a common size, small oval, with the first packaged mirror panes 26. The second packaged mirror panes 28 have a different style, however, such as deluxe glass, which may be clearer, have anti-fog treatment, a beveled perimeter edge, and/or etching.

An unpackaged mirror assembly 30, which includes one of the small oval mirror panes 26, is displayed in an upper region 32 of the display unit 22. The mirror assembly 30 is mounted to an upright support surface or wall 34 to illustrate the small oval mirror pane 26 in an installed orientation.

A user may desire an unframed mirror assembly, and may utilize one of the small oval mirror panes 26, 28 without a frame. However, if a user desires a framed mirror assembly, a plurality of small oval frames 36 are provided that are each sized to mount to one of the oval mirror panes 26, 28. The small oval frames 36 are offered in varying colors, finishes, ornamentation, widths, thicknesses and the like.

The mirror assembly 30 includes a half frame 38 to depict the mirror assembly 30 with and without a frame 36 to assist the user in making a decision. Additionally, multiple partial frame samples 40 are also provided on the wall 34 to illustrate other frame styles. The unpackaged mirror assembly 30 is aligned in the display unit 22 with the associated components, the small oval mirror panes 26, 28 and the small oval frames 36 so that these components are within a line of sight of the mirror assembly 30 to assist a customer in selecting the associated components.

The mirror pane and frame options may be repeated throughout the display system 20 to illustrate the various components. For example, the point-of-sale display unit 22 also includes small rectangular mirror panes 42 in standard and deluxe mirror materials. A variety of small rectangular frames 44 are provided adjacent the small rectangular mirror panes 42. A small rectangular mirror assembly 46 is provided in the upper region 32 with a half frame 48 and partial frame samples 49.

Additionally, medium rectangular mirror panes 50, medium rectangular frames 52, a medium rectangular mirror assembly 54, medium oval mirror panes 56, medium oval frames 58 and a medium oval mirror assembly 60 are provided in the point-of-display unit 22 with varying characteristics as described with the components for the small sized mirror components. Second medium rectangular mirror panes 62, second medium rectangular frames 64, a second medium rectangular mirror assembly 66, large rectangular mirror panes 68, large rectangular frames 70, a large rectangular mirror assembly 72, second large rectangular mirror panes 74, second large rectangular frames 76, a second large rectangular mirror assembly 78, large oval mirror panes 80, large oval frames 82, and a large oval mirror assembly 84, are provided within the point-of-display units 22, 24 offering varying styles at each of these sizes and shapes.

The display system provides mounting hardware kits 86 that are common or standardized for mounting any of the mirror panes 26, 28, 42, 50, 56, 62, 68, 74, 80. Although the hardware kits 86 are depicted as shelved on the point-of-display unit, the hardware kits 86 could be alternatively packaged with each of the packaged mirror panes 26, 28, 42, 50, 56, 62, 68, 74, 80.

Figure 2:
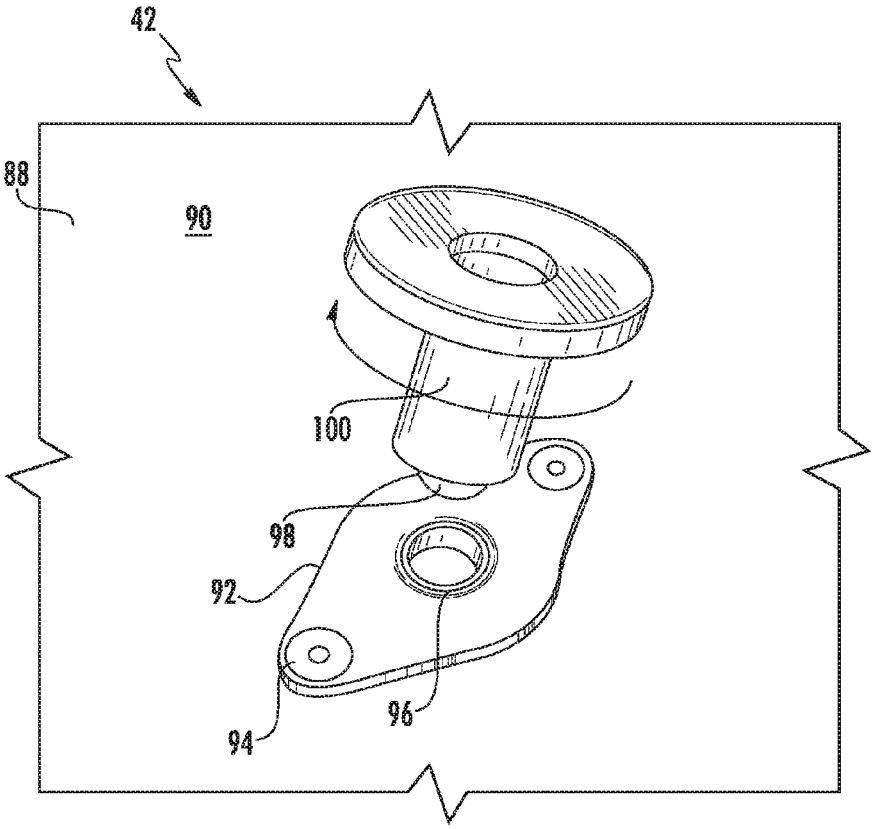
FIG. 2 is a perspective view illustrating an assembly operation of one of the mirror assemblies of FIG. 1 according to an embodiment.

FIG. 2 illustrates a rear surface 88 of one of the small rectangular mirror panes 42. The mirror pane 42 includes a laminated backing board 90 according to an embodiment. A series of mounting plates 92 are fastened to the backing board 90 with rivets 94. The mounting plates 92 include a threaded insert 96 to receive a threaded end 98 of a stud 100 of the mounting hardware kit 86. The studs 100 can be manually installed without requiring additional tools. Studs 100 of various lengths may be provided to offer various mounting distances from the wall, to accommodate various frame thicknesses, to provide a flat appearance against the wall, or to provide a floating appearance away from the wall. The mounting hardware kit 86 and various embodiments thereof, are illustrated and explained in further detail in U.S. application Ser. No. 15/004,512 filed Jan. 22, 2016, the disclosure of which is hereby incorporated in its entirety by reference herein. By providing a common mounting hardware kit 86 for all of the various mirror assembly options, interchangeability, modularity, replacement and reconfiguration are all permitted without additional hardware or tools.

Figure 3:
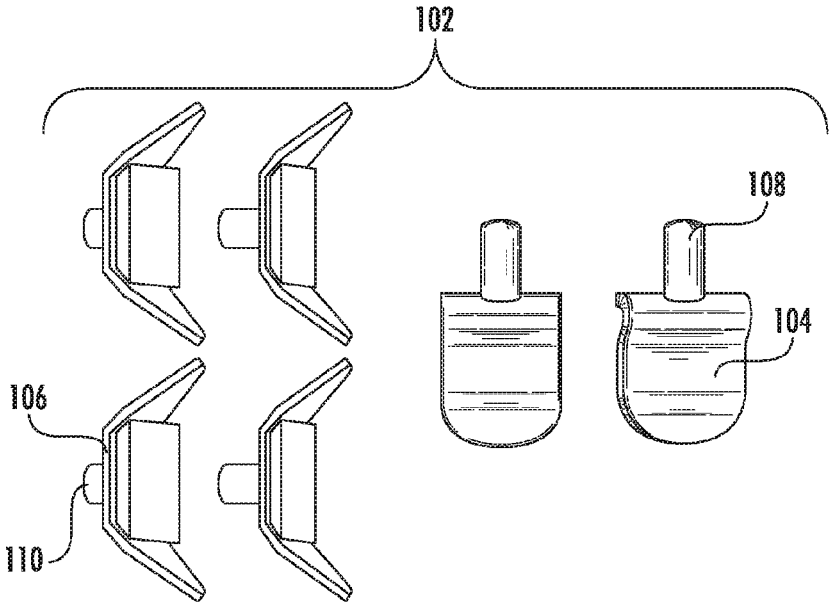
FIG. 3 is a front side elevation view of a frame assembly hardware kit of the mirror assembly of FIG. 2.

FIG. 3 illustrates a frame assembly hardware kit 102 according to an embodiment. The frame assembly hardware kit 102 is standardized for all of the frames 36, 44, 52, 58, 64, 70, 76, 82 for commonality, interchangeability, modularity, replacement and reconfiguration of various combinations of frames 36, 44, 52, 58, 64, 70, 76, 82 and mirror panes 26, 28, 42, 50, 56, 62, 68, 74, 80. For convenience, the frame assembly hardware kits 102 may be packaged with each of the frames 36, 44, 52, 58, 64, 70, 76, 82.

The frame assembly hardware kit 102 includes a pair of rigid polymeric retainer clips 104 and a plurality of elastically deformable polymeric locking clips 106. Each of the clips 104, 106 includes a pin 108, 110 for installation into a frame 36, 44, 52, 58, 64, 70, 76, 82.

Figure 4:
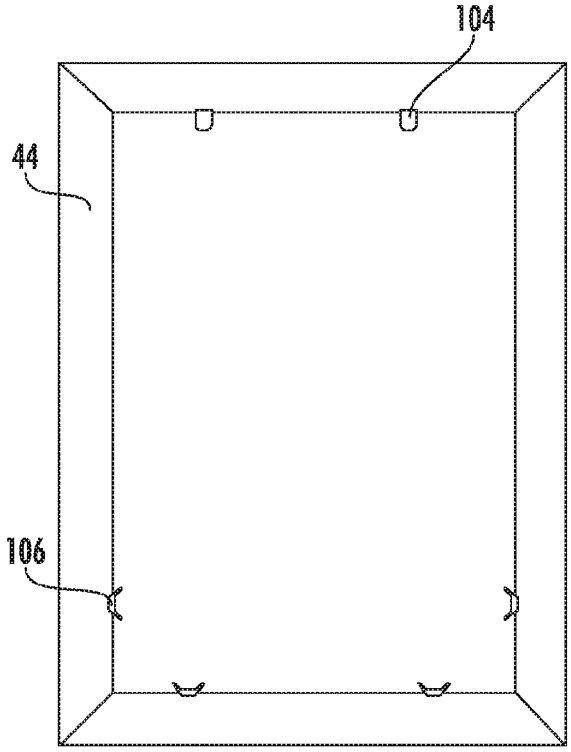
FIG. 4 is a rear side elevation view of a frame and frame assembly hardware kit of the mirror assembly of FIG. 2 in a portrait orientation.
Figure 5:
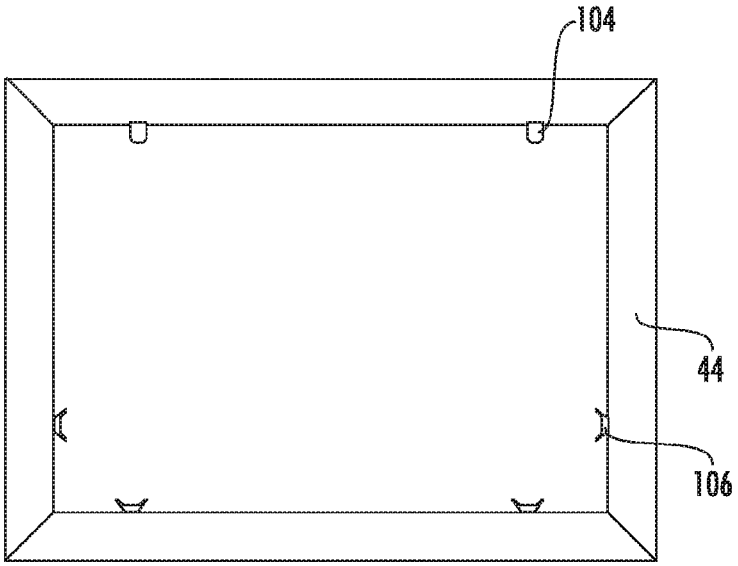
FIG. 5 is a rear side elevation view of a frame and frame assembly hardware kit of the mirror assembly of FIG. 2 in a landscape orientation.

FIGS. 4 and 5 illustrate one of the small rectangular frames 44 in a portrait orientation (FIG. 4) and a landscape orientation (FIG. 5). The rectangular frame 44 includes a series of apertures about an inner periphery, for example eight apertures, with two formed in each molding member of the frame 44, adjacent an intersection with another molding member, and facing an opposed oval member. The other rectangular frames 52, 64, 70, 76 include a similar aperture pattern. For oval frames 36, 58, 82, a similar aperture pattern is provided with two apertures in each quadrant, one of which faces a vertical direction, and the other faces a horizontal direction.

As illustrated in FIGS. 4 and 5, the retainer clips 104 are installed into the two apertures that are the upper apertures, relative to the intended installation orientation. The locking clips 106 are installed into two lower side apertures and the two apertures that are the lower apertures, relative to the intended installation orientation.

Figure 6:
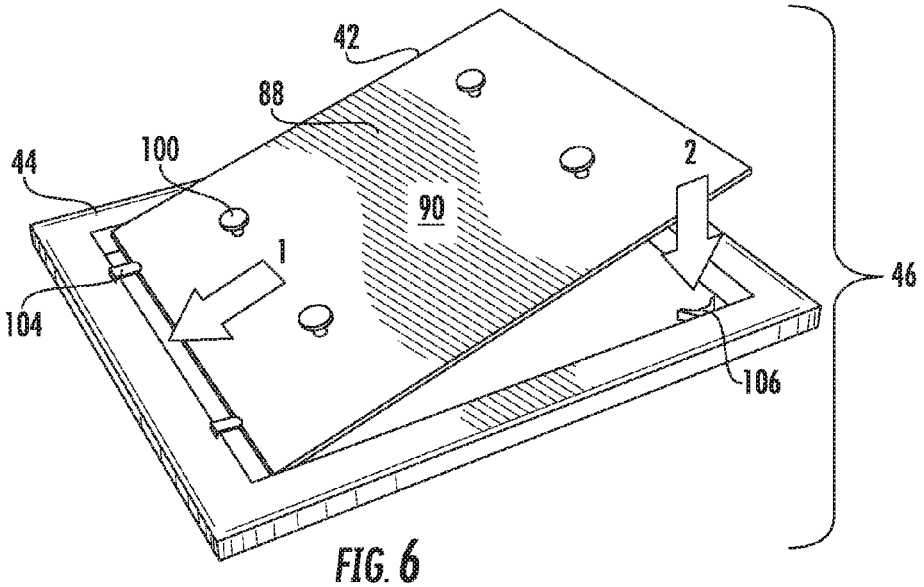
FIG. 6 is a rear perspective view of the mirror assembly of FIG. 2 illustrating another assembly operation.

FIG. 6 illustrates the installation of the mirror pane 42 into the frame 44. The mirror pane 42 is first angled with an upper edge translated beneath the rigid retainer clips 104. Subsequently, the mirror pane 42 is pressed into the frame 44 thereby deforming the locking clips 106 to collapse. Once the mirror pane 42 is properly seated in the frame 44, the locking clips 106 expand to lock the mirror pane 42 into the frame 44.

Figure 7:
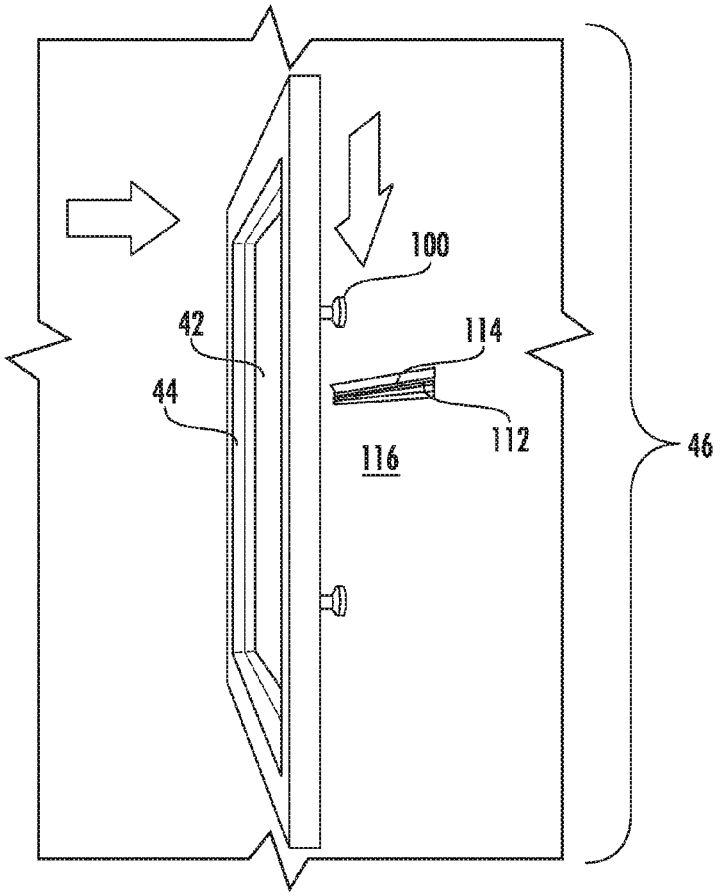
FIG. 7 is a side perspective view of the mirror assembly of FIG. 2 illustrating another assembly operation.

In FIG. 7, a bracket 112 with a cleat 114 is installed upon a wall 116. The upper studs 100 of the mirror assembly 46 are received in the cleat 114 to support the mirror pane 42, and consequently, the frame 44 upon the wall 116.

Figure 8:
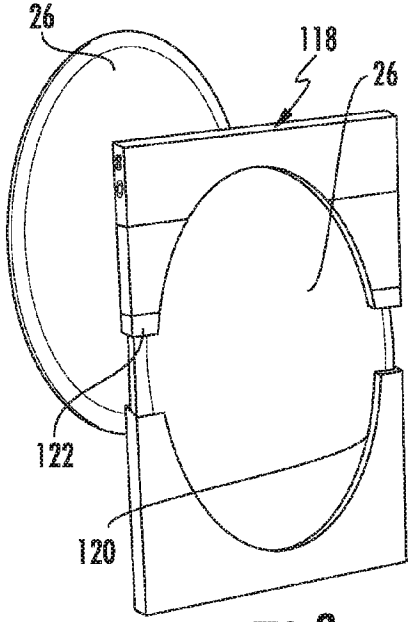
FIG. 8 is a front perspective view of a mirror pane and a packaged mirror pane of mirror assemblies of FIG. 1 according to an embodiment.

FIG. 8 illustrates one of the small oval mirror panes 26 adjacent to a packaged small oval mirror pane 26. The packaged small oval mirror pane 26 includes packaging 118 which may be formed from cardboard with internal foam to cushion the small oval mirror pane 26. The mirror display system 20 provides customer flexibility for selecting desired combinations of components to obtain various mirror assembly capabilities. Consequently, the individual components, such as the small oval mirror pane 26 are packaged individually. In order to assist the customers in making combinations that are compatible, the packaging 118 visually conveys information regarding the packaged component 26. For example, the packaging 118 includes a cutout 120 to expose the small oval mirror pane 26. Additionally, the cutout 120 includes an extension 122 to the perimeter to reveal that the small oval mirror pane 26 is packaged independently of a frame. Additionally, the cutout 120 is also generally oval-shaped to reflect the shape of the component 26 packaged therein.

Figure 9:
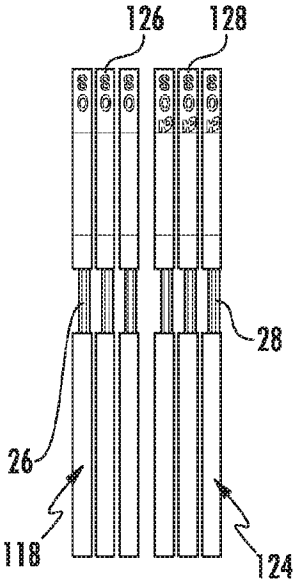
FIG. 9 is a side elevation view of a plurality of packaged mirror panes of mirror assemblies of FIG. 1 according to an embodiment.

FIG. 9 illustrates a plurality of the standard small oval panes 26, each in packaging 118. Also, a plurality of the deluxe glass small oval panes 28 are depicted in packaging 124. Each of the packages 118, 124 include informational indicia 126, 128 to indicate the size—S for small, shape—oval, and glass style—standard or deluxe. Additionally, the indicia 126, 128 include a common color coding that is repeated with mechanically compatible frames 36. The color coding on the indicia 126, 128 assists the user in finding a compatible frame 36 for the selected mirror pane 26, 28.

Referring again to FIG. 1, the small oval frames 36 are retailed in packages 130 that also include cutouts 132 that expose the frame 36 and reveal that the frame 36 is packaged without a mirror pane 26, 28. The package 130 also includes informational indicia 134 that indicate the size, style and material of the frame 36. The indicia 134 is also color coded to correspond to the packages 118, 124 of the compatible mirror panes 26, 28. The display unit 22 may also include indicia 136 that is similarly color coded for the small oval mirror assembly 30 to indicate which components are associated with the displayed mirror assembly 30. These packaging features and informational indicia including color coding may be repeated throughout the display system 20 as illustrated for assisting customers in the selection process.

Figure 11:
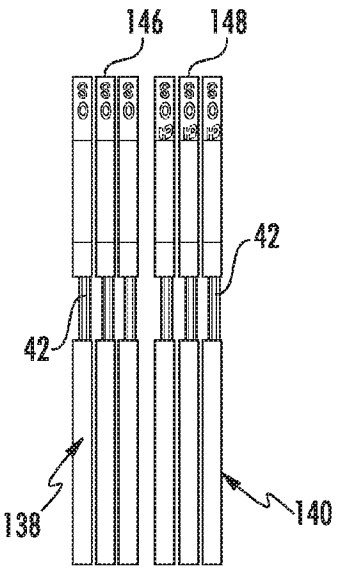
FIG. 11 is a side elevation view of a plurality of packaged mirror panes of mirror assemblies of FIG. 1 according to an embodiment.
Figure 10:
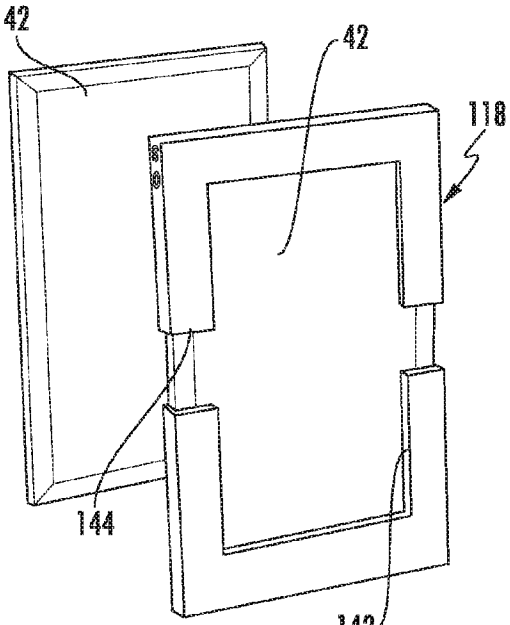
FIG. 10 is a front perspective view of a mirror pane and a packaged mirror pane of mirror assemblies of FIG. 1 according to another embodiment.

FIGS. 10 and 11 illustrate a small rectangular mirror pane 42 unpackaged and in packages 138, 140. The package 138 includes a cutout 142 that is rectangular in shape to match the quadrilateral shape of the mirror pane 42. A cutout extension 144 reveals the perimeter of the mirror pane 42 to reveal that a frame is not included in the package 138. The packages 138, 140 each include indicia 146, 148 to indicate the style of the mirror pane 42—standard or deluxe, the size—small, and the shape—quadrilateral or rectangular. The indicia 146, 148 is also color coded with similar compatible articles.

Figure 12:
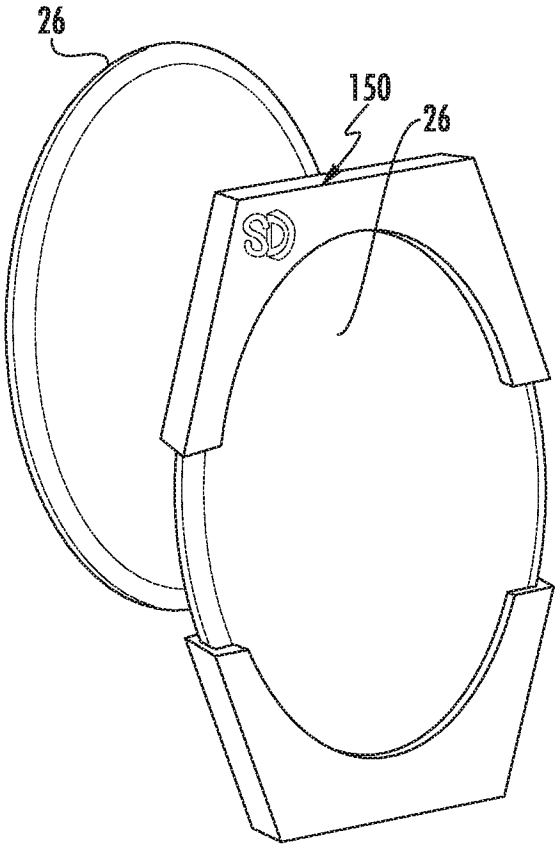
FIG. 12 is a front perspective view of a mirror pane and a packaged mirror pane of mirror assemblies of FIG. 1 according to another embodiment.

FIG. 12 illustrates the small oval mirror pane 26 with a package 150 according to another embodiment. The package 150 has an outer perimeter that is not a quadrilateral to further emphasize that the mirror pane 26 is not a rectangular mirror pane 42 to assist the customer in selecting the appropriate mirror pane 26 and to minimize confusion when selecting the desired mirror pane 26.

Figure 13:
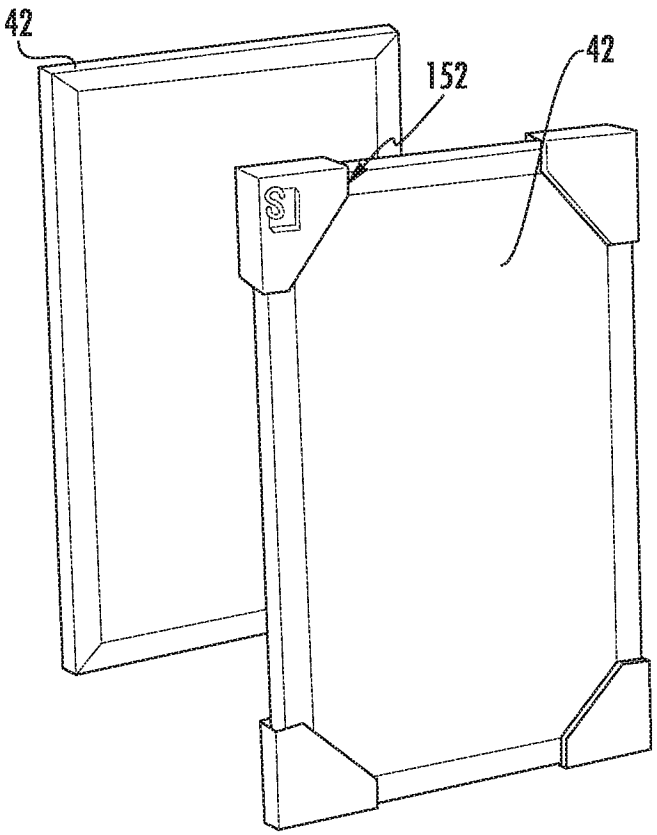
FIG. 13 is a front perspective view of a mirror pane and a packaged mirror pane of mirror assemblies of FIG. 1 according to another embodiment.

FIG. 13 illustrates the small rectangular mirror pane 42 with an alternative package 152 that is reduced to only corners on the front surface to further reveal that the packaged mirror pane 42 is rectangular, and not oval. The packaging 152 visually assists the customer in making the appropriate mirror pane 42 selection.

Figure 14:
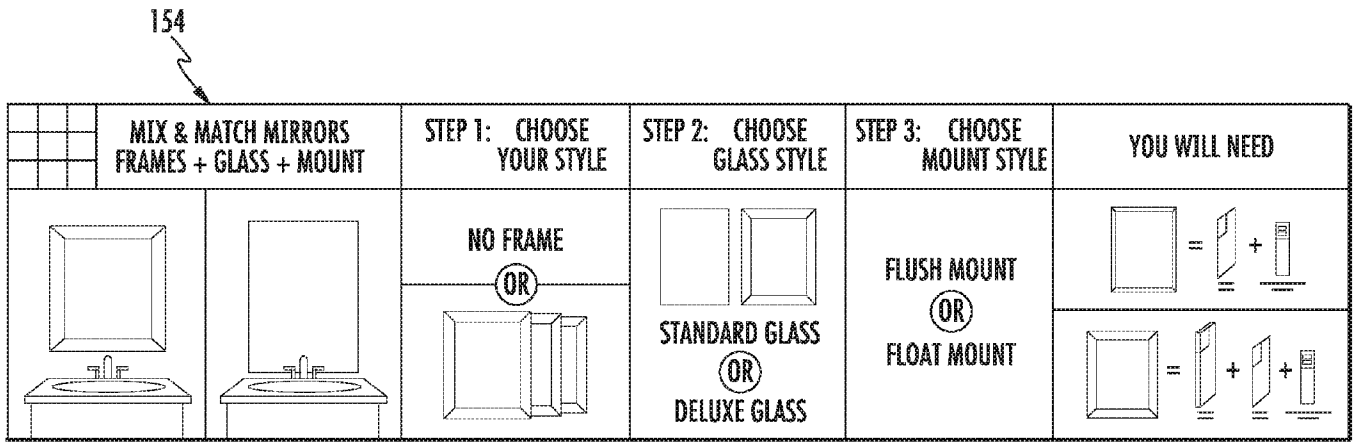
FIG. 14 is front elevation view of instructional indicia of the display system of FIG. 1 according to an embodiment.

Referring again to FIG. 1, the display system 20 includes signage with instructional indicia to inform the customer regarding a process to select the appropriate components for a desired mirror assembly. The signage is illustrated in greater detail in FIG. 14. In step 1, the customer, chooses a style, no frame or framed. If framed is desired, the customer selects a desired frame. In step 2, the customer selects a glass style, standard or deluxe. During this selection, the customer selects a mirror pane that matches the size and shape of the selected frame. In step 3, the customer determines if the installation will be flush mount or float mount, and the appropriate mounting hardware is selected.

Figure 15:
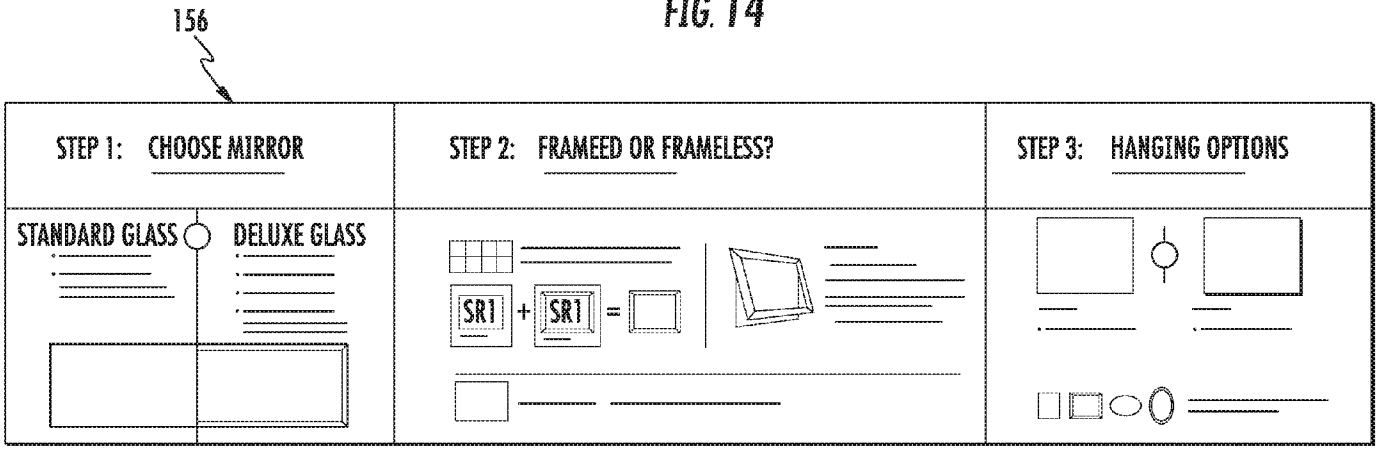
FIG. 15 is front elevation view of instructional indicia of the display system of FIG. 1 according to another embodiment.

Signage 156 is illustrated in FIG. 15 according to another embodiment. In step 1, the customer selects a glass style, shape and size. In step 2, the customer determines if a frame is desired. If so, the customer selects a frame style that matches the size and shape of the selected glass shape and size. In step 3, the customer determines if the installation will be flush mount or float mount, and the appropriate mounting hardware is selected.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A retail display system comprising:

a point-of-sale display unit sized to be received in a retail store aisle;

a first plurality of planar display panes with a first size and a first style oriented within the display unit;

a second plurality of planar display panes with a second size and second style oriented within the display unit, wherein at least one of the second size and the second style is different from the first size and the first style; and mounting hardware kits that are common for both of the first plurality of planar display panes and the second plurality of planar display panes, oriented within the display unit, to mount one of the first plurality of planar display planes and the second plurality of planar display panes at varying distances from an upright support surface;

wherein the first style is further defined as a first mirror material; and wherein the second style is further defined as a second mirror material.

2. The retail display system of claim 1 wherein the first style is further defined as a round shape; and wherein the second style is further defined as a quadrilateral shape.

3. The retail display of claim 1 wherein the mounting hardware kits are packaged separately for retail.

4. The retail display system of claim 1 further comprising:

first packages sized to receive one of the first plurality of planar display panes; and second packages sized to receive one of the second plurality of display panes.

5. The retail display system of claim 4 wherein each of the first packages and the second packages are sized to receive at least one of the mounting hardware kits oriented therein.

6. The retail display system of claim 4 wherein the first style is further defined as a round shape;

wherein the second style is further defined as a quadrilateral shape;

wherein each of the first packages have a perimeter that is not a quadrilateral shape; and wherein each of the second packages have a perimeter that is a quadrilateral shape.

7. The retail display system of claim 4 wherein the first style is further defined as a round shape;

wherein the second style is further defined as a quadrilateral shape;

wherein each of the first packages are formed with a cutout that is not a quadrilateral shape to view the first pane packaged therein; and wherein each of the second packages are formed with a cutout that is a quadrilateral shape to view the second pane packaged therein.

8. A retail display system comprising:

a point-of-sale display unit sized to be received in a retail store aisle;

a first plurality of planar mirrors oriented within the display unit;

at least one first frame with a first size and a first style, sized to mount about one of the first plurality of planar mirrors, and oriented within the display unit; and at least one second frame with a second size and a second style, sized to mount about one of the first plurality of planar mirrors, and oriented within the display unit, wherein at least one of the second size and the second style is different from the first size and the first style;

wherein the first size is further defined as a first thickness;

wherein the second size is further defined as a second thickness;

first mounting hardware kits to mount the first plurality of planar mirrors at a first distance from an upright support surface for the first thickness of the at least one first frame, oriented within the display unit; and second mounting hardware kits to mount the first plurality of planar mirrors a second distance from an upright support surface for the second thickness of the at least one second frame, oriented within the display unit.

9. The retail display system of claim 8 further comprising frame assembly hardware kits common for both the at least one first frame and the at least one second frame, oriented in the display unit, to interchangeably mount the at least one first frame and the at least one second frame to one of the first plurality of planar mirrors.

10. The retail display system of claim 8 wherein the first style is further defined as a round shape; and wherein the second style is further defined as a quadrilateral shape.

11. The retail display of claim 8 wherein the first mounting hardware kits are packaged separately for retail; and wherein the second mounting hardware kits are packaged separately for retail.

12. The retail display system of claim 8 further comprising:

a first frame package for the at least one first frame; and a second frame package for the at least one second frame.

13. The retail display system of claim 12 further comprising frame assembly hardware kits common for both the at least one first frame and the at least one second frame, to interchangeably mount the at least one first frame and the at least one second frame to one of the first plurality of planar mirrors, wherein the frame assembly hardware kits are oriented in each of the first frame package and the second frame package.

14. The retail display system of claim 12 wherein each of the first frame package and the second frame package is formed with a cutout therein to reveal that each frame package does not include one of the first plurality of planar mirrors.

15. The retail display system of claim 12 further comprising first mirror packages sized to receive one of the first plurality of planar mirrors, wherein each of the first mirror packages are formed with a cutout in a perimeter to reveal that the first mirror packages do not include a frame.

16. The retail display system of claim 15 wherein the first plurality of planar mirrors have a first mirror size and a first mirror style, oriented within the display unit; and wherein the retail display system further comprises:

first mirror packages sized to receive one of the first plurality of planar mirrors, a second plurality of planar mirrors with a second mirror size and a second mirror style oriented within the display unit, wherein at least one of the second mirror size and the second mirror style is different from the first mirror size and the first mirror style, second mirror packages sized to receive one of the second plurality of planar mirrors, and instructional indicia provided on each of the first frame package, the second frame package, the first pane packages and the second mirror packages to inform a customer regarding a process to select at least one planar display mirror and at least one frame.

17. The retail display system of claim 16 further comprising:

at least one third frame with a third size and a third style, sized to mount about one of the second plurality of planar mirrors, and oriented within the display unit;

a third frame package sized to receive the at least one third frame;

at least one fourth frame with a fourth size and a fourth style, sized to mount about one of the second plurality of planar mirrors, and oriented within the display unit, wherein at least one of the fourth size and the fourth style is different from the third size and the third style;

a fourth frame package sized to receive the at least one fourth frame; and instructional indicia provided on each of the third frame package, and the fourth frame package to inform a customer to select at least one planar display mirror and at least one frame.

18. The retail display system of claim 8 wherein the first plurality of planar mirrors have a first size and a first style;

wherein the retail display system further comprises a second plurality of planar mirrors with a second size and second style oriented within the display unit, wherein at least one of the second size and the second style is different from the first size and the first style;

wherein the at least one first frame comprises a first plurality of frames;

wherein the at least one second frame comprises a second plurality of frame with a second size and a second style; and wherein the retail display system further comprises instructional indicia provided on the display unit to inform a customer to select at least one planar display pane and at least one frame.

19. The retail display system of claim 18 further comprising;

a third plurality of frames with a third size and a third style, sized to receive one of the second plurality of planar mirrors, and oriented within the display unit; and a fourth plurality of frames with a fourth size and a fourth style, sized to receive one of the second plurality of planar mirrors, and oriented within the display unit, wherein at least one of the fourth size and the fourth style is different from the third size and the third style.

20. A method for retailing customizable mirror assemblies:

providing a plurality of mirror panes with varying sizes and varying styles oriented within a display unit;

providing a plurality of frames with varying sizes and varying styles within the display unit, the plurality of frames each sized to receive one of the plurality of mirror panes;

providing mounting hardware kits that are common for the plurality of mirror panes to mount the plurality of mirror panes to an upright support surface; and providing instructional indicia to inform a customer to select at least one mirror pane, to determine if the mirror pane is to be framed and if so, to select at least one frame that is sized for the at least one mirror pane, and to select one of the mounting hardware kits.

* * * * *